US006845166B2

(12) United States Patent
Hara et al.

(10) Patent No.: US 6,845,166 B2
(45) Date of Patent: Jan. 18, 2005

(54) PLANE DRIVING TYPE ELECTROACOUSTIC TRANSDUCER

(75) Inventors: Akira Hara, Akishima (JP); Kunio Kondo, Akishima (JP)

(73) Assignee: Foster Electric Co., Ltd., Tokyo (JP)

( * ) Notice: Subject to any disclaimer, the term of this patent is extended or adjusted under 35 U.S.C. 154(b) by 78 days.

(21) Appl. No.: 09/984,054

(22) Filed: Oct. 26, 2001

(65) Prior Publication Data

US 2002/0061116 A1 May 23, 2002

(30) Foreign Application Priority Data

Nov. 2, 2000 (JP) ..... 2000-335826

(51) Int. Cl.[7] ..... H04R 25/00
(52) U.S. Cl. ..... 381/399; 381/408; 381/431
(58) Field of Search ..... 381/190, 396, 381/191, 417, 418, 423, 431, 176, 399, 408; 181/164, 171–173

(56) References Cited

U.S. PATENT DOCUMENTS 3,829,623 A * 8/1974 Willis et al. ..... 381/186
4,037,061 A * 7/1977 von Recklinghausen .... 381/408
4,210,786 A * 7/1980 Winey ..... 381/408
4,242,541 A * 12/1980 Ando ..... 381/99
4,281,223 A * 7/1981 Ugaji et al. ..... 381/408
4,338,489 A * 7/1982 Gorike ..... 381/117
4,468,530 A * 8/1984 Torgeson ..... 381/402
4,471,172 A * 9/1984 Winey ..... 381/427
4,803,733 A * 2/1989 Carver et al. ..... 381/398
5,003,609 A * 3/1991 Muraoka ..... 381/408
5,003,610 A * 3/1991 Adachi et al. ..... 381/431
5,297,214 A * 3/1994 Bruney ..... 381/431
5,430,805 A * 7/1995 Stevenson et al. ..... 381/408
5,627,903 A * 5/1997 Porrazzo et al. ..... 381/423
5,901,235 A * 5/1999 Thigpen et al. ..... 381/431
6,097,830 A * 8/2000 Zelinka et al. ..... 381/431
6,185,310 B1 * 2/2001 Kermani et al. ..... 381/431

* cited by examiner

*Primary Examiner*—Curtis Kuntz
*Assistant Examiner*—Phylesha Dabney
(74) *Attorney, Agent, or Firm*—Finnegan, Henderson, Farabow, Garrett & Dunner, L.L.P.

(57) ABSTRACT

A plane driving type electroacoustic transducer having a film of diaphragm with a conduction pattern formed thereon and a magnetic circuit, wherein a vibration damping layer is provided on the diaphragm.

4 Claims, 10 Drawing Sheets

PLANE DRIVING TYPE ELECTROACOUSTIC TRANSDUCER

BACKGROUND OF THE INVENTION

1. Field of the Invention

The present invention relates to a plane driving type electroacoustic transducer comprising a film of diaphragm with a conduction pattern formed thereon and a magnetic circuit.

2. Description of the Prior Art

The following description will describe a plane driving type electroacoustic transducer of t he prior art with reference to FIG. 10.

A plurality of rodlike magnets 3 are evenly or almost evenly spaced apart inside a case of yoke 1 having its top face as an open face. As is illustrated in the drawing, these magnets 3 are placed so that the magnetization directions of the neighboring magnets 3 are opposite, whereby the yoke 1 and the magnets 3 form a magnetic circuit.

A diaphragm 5 composed of a film 6 and conduction patterns 7 formed on the film 6 is provided to cover the open face of the yoke 1.

In FIG. 10 explaining the prior art, the conduction patterns 7 are provided on one surface of the film 6 alone. It should be appreciated, however, that the conduction patterns 7 may be provided on both the surfaces of the film 6 as occasion demands.

The conduction patterns 7 have portions 7*a* that intersect at right angles with magnetic fluxes developed across opposite polarities of the magnets 3.

Hence, as a current flows through the conduction patterns 7, the conduction patterns 7 exert a driving force at the portions 7*a* that intersect at right angles with the magnetic fluxes. In case that the current is an alternating current, the diaphragm 5 vibrates and the electroacoustic transducer functions as a loudspeaker.

Further, in case that the diaphragm 5 vibrates by aerial vibrations, a current is generated in the conduction patterns 7 and the electroacoustic transducer functions as a microphone.

However, the plane driving type electroacoustic transducer arranged as above has problems as follows.

(1) Because the diaphragm 5 is composed of an extremely thin film with the conduction patterns 7 formed thereon, a vibration damping effect of the film itself is so poor that problematic abrupt attenuation readily occurs.

(2) In order to function effectively as an electroacoustic transducer, it is preferable to extend the length and increase the count of the portions 7*a* that intersect at right angles with the magnetic fluxes of the conduction patterns 7. On the other hand, flexural rigidity in a direction (a direction indicated by a capital A in the drawing: magnetic gap direction) intersecting at right angles with the magnetic fluxes of the diaphragm 5 is large in comparison with flexural rigidity in a direction (a direction indicated by a capital B in the drawing) intersecting at right angles with the magnetic gap direction, and there is a significant difference in flexural rigidity between the two directions, which often adversely affects the vibrations of the diaphragm 5.

(3) In case that the conduction patterns 7 are formed on the both surfaces of the film 6, the conduction patterns 7 on the respective surfaces are formed at the same position as viewed through the surfaces. This makes the above-described difference in flexural rigidity between the directions A and B far larger.

(4) Because the film 6 forming the diaphragm 5 is so thin that the diaphragm 5 by itself cannot hold its shape, the diaphragm 5 needs to be given with a tensile force constantly during positioning and assembly, which results in poor workability.

SUMMARY OF THE INVENTION

The present invention was devised to solve the above problems, and therefore, has a first object to provide a plane driving type electroacoustic transducer, in which the diaphragm hardly causes problematic abrupt attenuation so that distortion is lessened.

A second object of the invention is to provide a plane driving type electroacoustic transducer, in which the diaphragm has a small difference in flexural rigidity between the directions so that distortion is lessened.

A third object of the invention is to provide a plane driving type electroacoustic transducer, with which the workability of assembly is improved.

In order to achieve the above objects, a first aspect of the invention provides a plane driving type electroacoustic transducer furnished with a film of diaphragm with a conduction pattern formed thereon and a magnetic circuit, wherein a vibration damping layer is provided on the diaphragm.

By providing the vibration damping layer on the diaphragm, problematic abrupt attenuation does not occur when the diaphragm vibrates.

A second aspect of the invention provides a plane driving type electroacoustic transducer, wherein the diaphragm is produced by forming a thin film layer of conductive metal on a base film through a bonding layer and forming the conduction pattern from the thin film layer by means of etching, and the bonding layer functions as the vibration damping layer.

By using the bonding layer as the vibration damping layer, a separate vibration damping layer does not have to be provided, thereby making it possible to save the costs.

A third aspect of the invention provides a plane driving type electroacoustic transducer furnished with a film of diaphragm with a conduction pattern formed thereon and a magnetic circuit, wherein the conduction pattern is coiled, and a driving force generating portion of the conduction pattern is formed in a zigzag manner with respect to a direction (hereinafter, occasionally referred to as a magnetic gap direction) intersecting at right angles with a direction of a magnetic flux of the magnetic circuit along a planar direction of the film of diaphragm.

By forming the driving force generating portion of the conduction pattern in a zigzag manner with respect to a direction intersecting at right angles with a direction of a magnetic flux of the magnetic circuit along a planar direction of the film of diaphragm, the flexural rigidity in the magnetic gap direction is reduced, and as a consequence, a difference in flexural rigidity between the directions is lessened and so is the distortion.

A fourth aspect of the invention provides a plane driving type electroacoustic transducer, wherein the coiled conduction pattern is provided on both surfaces of the film of diaphragm at a same position, and zigzagged portions of the driving force generating portions on respective surfaces together form a grid pattern as viewed through the film of diaphragm.

Even when the coiled conduction pattern is provided on the both surfaces of the film of diaphragm at the same position, the zigzagged portions of the driving force generating portions on the respective surfaces together form a grid pattern as viewed through the film of diaphragm. Hence, the flexural rigidity in the magnetic gap direction is reduced, and as a consequence, a difference in flexural rigidity between the directions of the diaphragm is lessened, and so is the distortion.

A fifth aspect of the invention provides a plane driving type electroacoustic transducer furnished with a film of diaphragm with a conduction pattern formed thereon and a magnetic circuit, wherein the conduction pattern is formed in a zigzag manner with respect to a direction intersecting at right angles with a magnetic gap direction.

By forming the conduction pattern in a zigzag manner with respect to a direction intersecting at right angles with the magnetic gap direction, there is little difference in flexural rigidity between the directions of the diaphragm, and as a consequence, the distortion is lessened.

A sixth aspect of the invention provides a plane driving type electroacoustic transducer, wherein the conduction pattern is provided on both surfaces of the film of diaphragm, and zigzagged portions of the conduction patterns on respective surfaces together form a grid pattern as viewed through the film of diaphragm.

By providing the conduction pattern on the both surfaces of the film of diaphragm so that the zigzagged portions of the conduction patterns on the respective surfaces together form a grid pattern as viewed through the film of diaphragm, a difference in flexural rigidity between the directions of the diaphragm is lessened and so is the distortion.

A seventh aspect of the invention provides a plane driving type electroacoustic transducer furnished with a film of diaphragm with a conduction pattern formed thereon and a magnetic circuit, wherein a reinforcing portion is provided at a periphery of the diaphragm.

By providing the reinforcing portion at the periphery of the diaphragm, the diaphragm is enabled to hold its shape by itself, thereby improving the workability of assembly of the diaphragm.

An eighth aspect of the invention provides a plane driving type electroacoustic transducer, wherein the reinforcing portion is formed with the conduction pattern.

By forming the reinforcing portion with the conduction pattern, the productivity is enhanced.

A ninth aspect of the invention provides a plane driving type electroacoustic transducer, wherein the reinforcing portion is provided with a locating hole for use with the diaphragm.

By providing the reinforcing portion with a locating hole for use with the diaphragm, the productivity is enhanced.

A tenth aspect of the invention provides a plane driving type electroacoustic transducer, wherein the reinforcing portion is provided with a clamping hole for use with the diaphragm.

By providing the reinforcing portion with a clamping hole for use with the diaphragm, the productivity is enhanced.

DETAILED DESCRIPTION OF THE PREFERRED EMBODIMENT

The following description will describe example embodiments of the present invention with reference to the accompanying drawings.

Overall Arrangement

Figure 2:
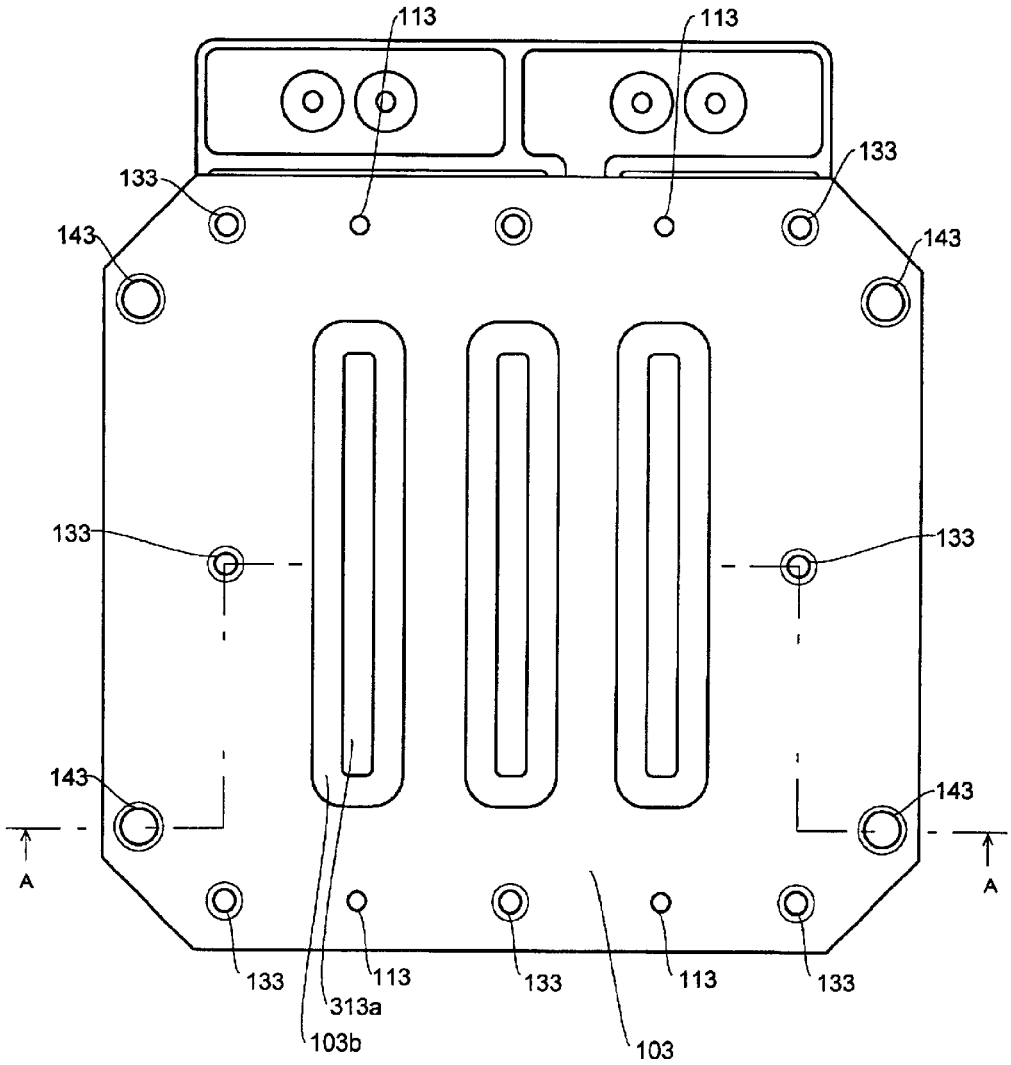
FIG. 2 is a plan view of a plane driving type electroacoustic transducer of one example embodiment.
Figure 3:
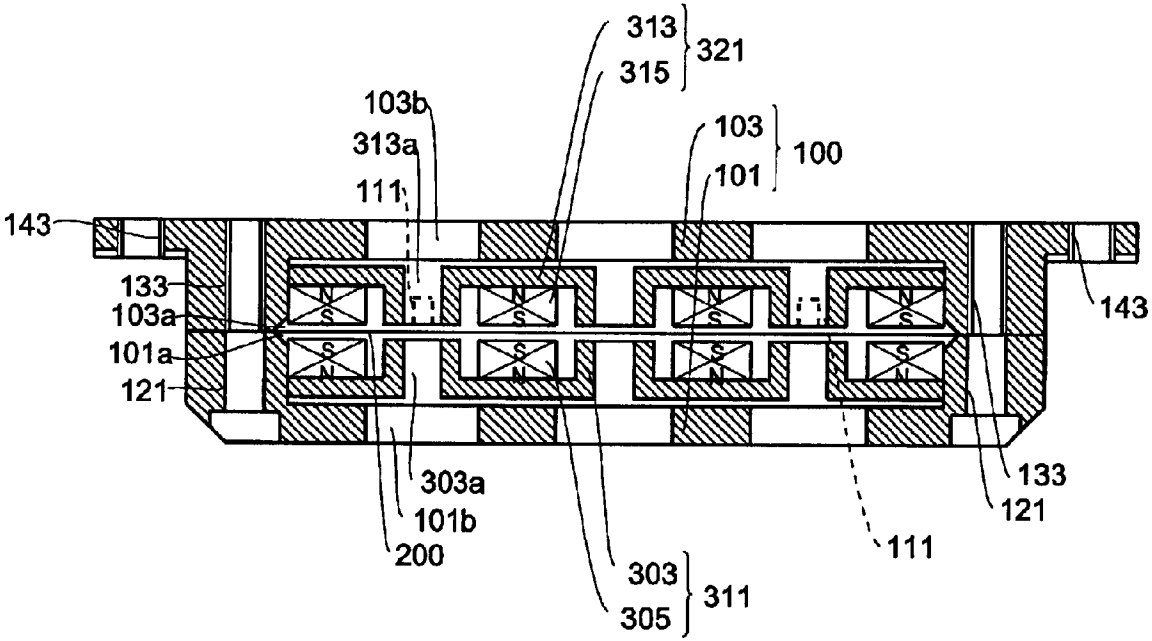
FIG. 3 is a cross section taken along the line A—A of FIG. 2.

In the first place, the following description will describe, with reference to FIGS. 2 and 3, an overall arrangement of a plane driving type electroacoustic transducer of the present example embodiment. FIG. 2 is a plan view and FIG. 3 is a cross section taken along the line A—A of FIG. 2.

With referring to these drawings, a housing 100 comprises a first housing 101 having its one face as an open face 101*a* and a second housing 103 having its one face as an open face 103*a*. The first housing 101 and second housing 103 sandwich a diaphragm 200 with the open face 101*a* of the first housing 101 and the open face 103*a* of the second housing 103 opposing each other.

Each first magnetic circuit 311 is composed of a yoke 303 and a rodlike magnet 305 magnetized in a first direction, and is provided in a space surrounded by the first housing 101 and the diaphragm 200.

Each second magnetic circuit 321 is composed of a yoke 313 and a rodlike magnet 315 magnetized in a second direction, and is provided in a space surrounded by the second housing 103 and the diaphragm 200.

In order to deliver aerial vibrations produced by the diaphragm 200 to the outside and to deliver aerial vibrations from the outside to the diaphragm 200, long holes 303*a* and 313*a* are provided between the adjacent yokes 303 forming the first magnetic circuits 311 and between the adjacent yokes 313 forming the second magnetic circuits 321, respectively, while long holes 101*b* and 103*b* are provide to the first and second housings 101 and 103, respectively, in such a manner that the long holes 303*a* and 101*b* oppose each other while the long holes 313*a* and 103*b* oppose each other.

Also, the first housing 101 is provided with locating pins 111 that fit into holes 113 formed in the second housing 103.

Further, the first housing 101 is provided with holes 121 at its periphery, and the second housing 103 is provided with female screw holes 133 at its periphery so as to oppose the holes 121 in the first housing 101. Clamping screws (not shown) are inserted into the holes 121 and brought into threading engagement with the female screw holes 133, whereby the first housing 101 and the second housing 103 are made into one body.

The second housing 103 is provided with attachment holes 143 for use in attaching the electroacoustic transducer.

Diaphragm

Figure 4:
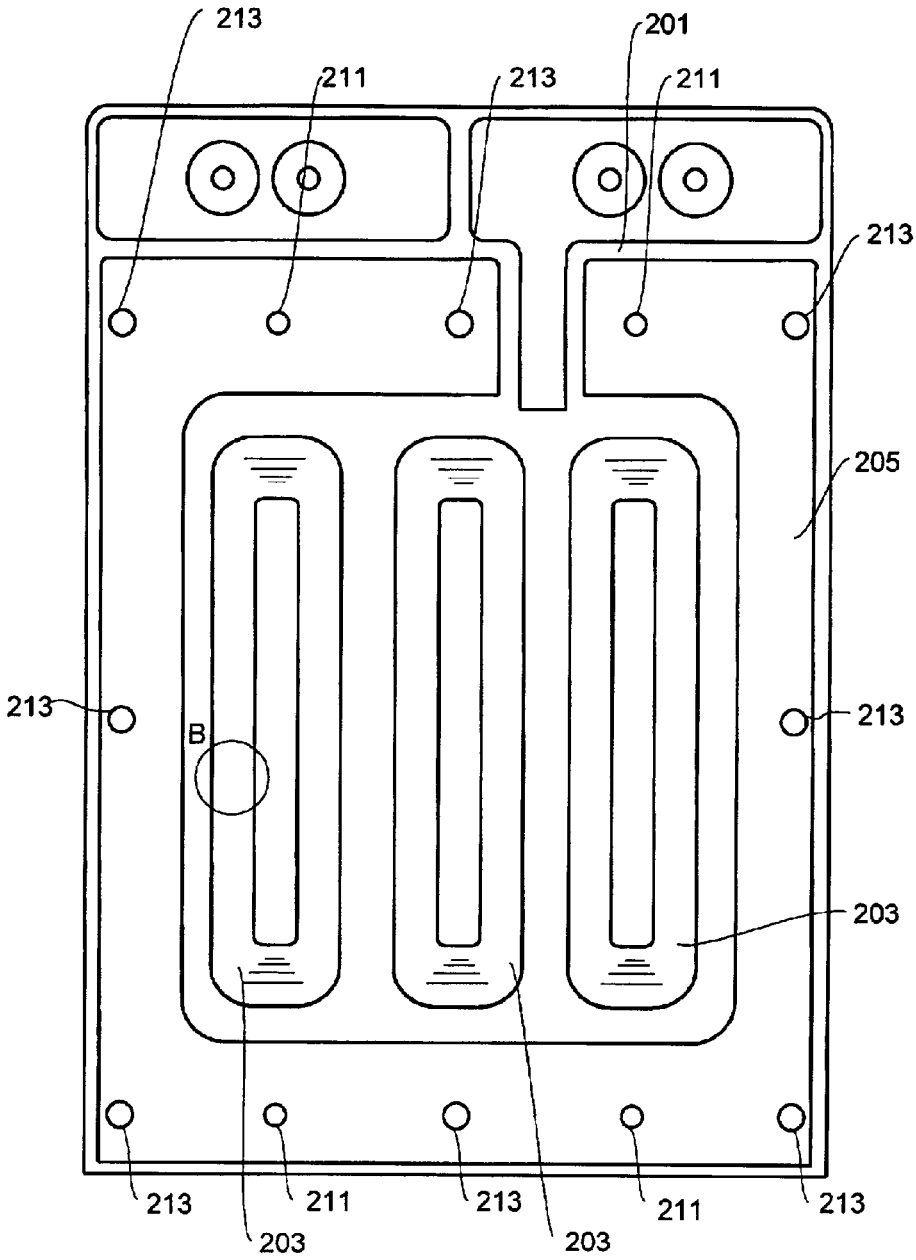
FIG. 4 is a plan view of the diaphragm of FIG. 2.

Next, the following description will describe the diaphragm 200 with reference to FIG. 4.

The diaphragm 200 is produced by forming a thin film layer of conductive metal on a base film 201, and forming coiled conduction patterns 203 from the thin film layer by means of etching.

Additionally, the diaphragm 200 is provided with a reinforcing portion 205 at its periphery, which is formed with the conduction patterns when they are formed. The reinforcing portion 205 is provided with locating holes 211 into which the locating pins 111 of the first housing 101 are inserted, and with clamp holes 213 into which the clamping screws are inserted.

Conduction Patterns

Figure 5:
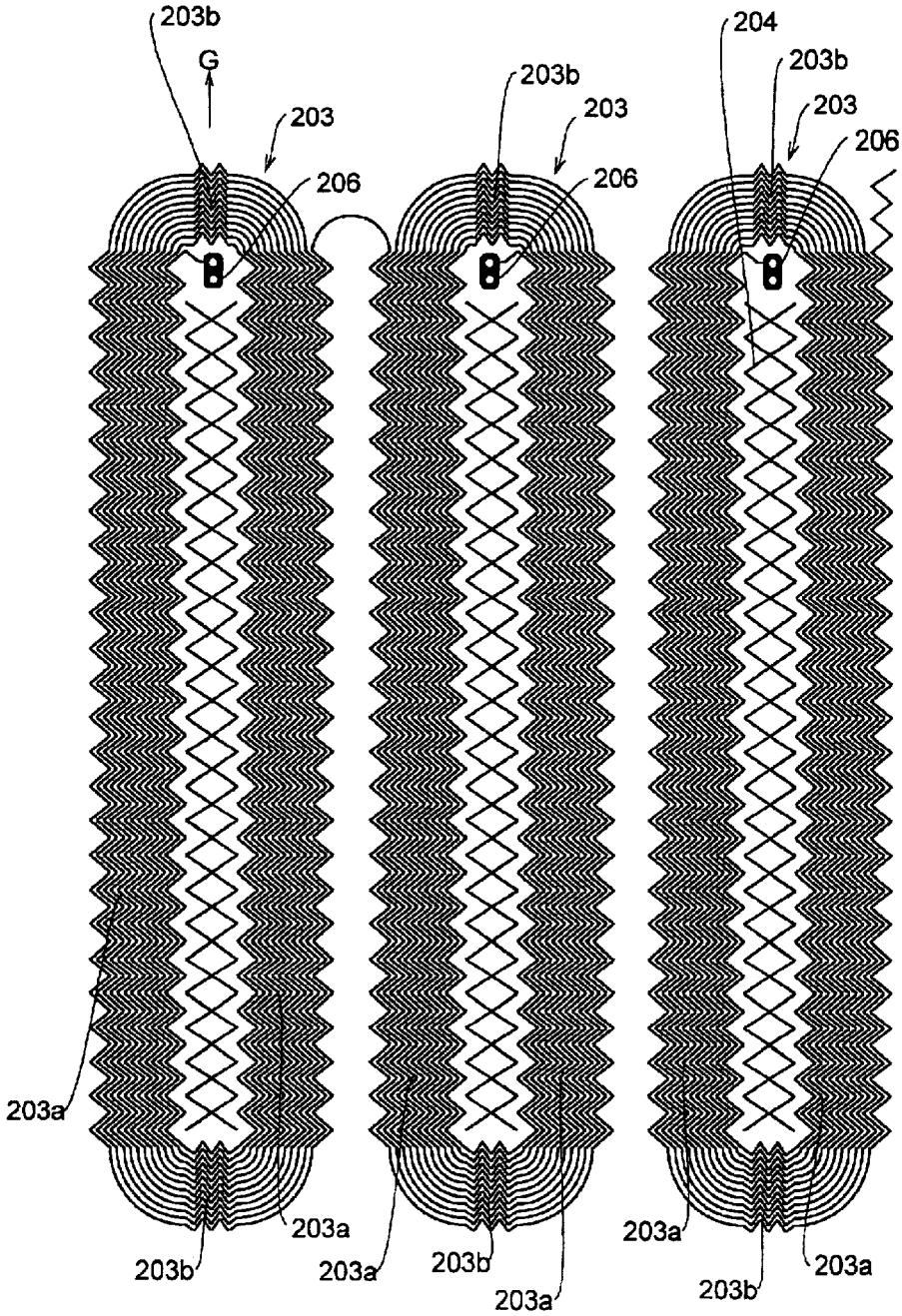
FIG. 5 is a view explaining conduction patterns on one surface of the diaphragm of FIG. 4.

Next, the following description will describe, with reference to FIG. 5, the conduction patterns 203 formed on one surface of the diaphragm 200.

In the case of the coiled conduction patterns 203, portions that intersect at right angles with magnetic fluxes developed by the first and second magnetic circuits 311 and 321 as a current flows through the conduction patterns 203, that is, driving force generating portions 203*a*, are formed in a zigzag manner with respect to a direction (magnetic gap direction G) intersecting at right angles with the direction of the magnetic fluxes of the magnetic circuits along the planar direction of the diaphragm 200.

Also, portions that intersect at right angles with the magnetic gap direction G of the conduction patterns 203, that is, driving force non-generating portions 203*b*, are formed in a zigzag manner as well.

Further, a zigzag pattern 204, which is formed in a zigzag manner with respect to the magnetic gap direction G, is provided inside of each coiled conduction pattern 203.

Figure 6:
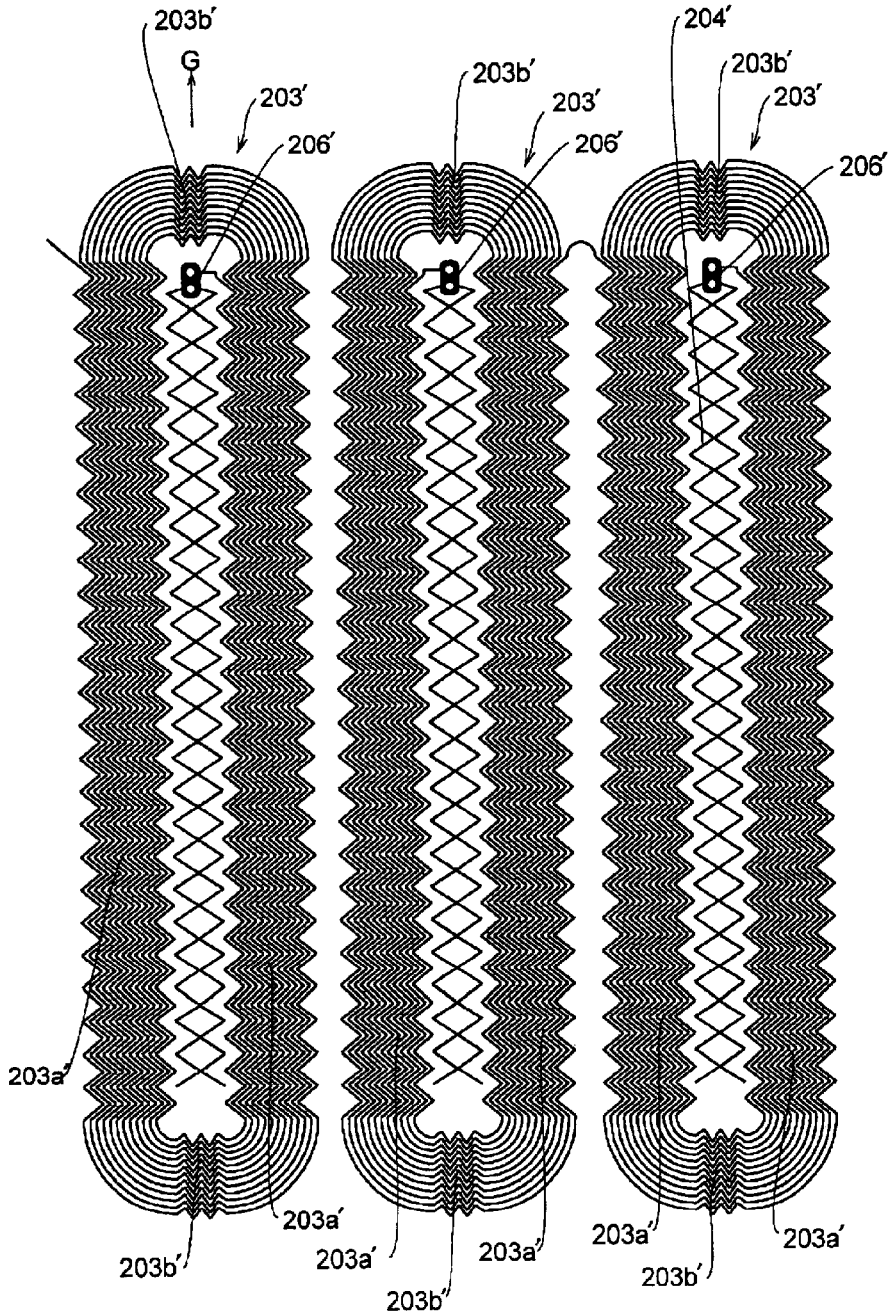
FIG. 6 is a view explaining conduction patterns on the other surface of the diaphragm of FIG. 4.

On the other hand, conduction patterns 203' as shown in FIG. 6 are formed on the other surface of the diaphragm 200 at the same position to oppose the conduction patterns 203.

In FIGS. 5 and 6, numerals 206 and 206' denote two-surfaces conducting portions that electrically connect the conduction patterns 203 and the other conduction patterns 203'.

Figure 7:
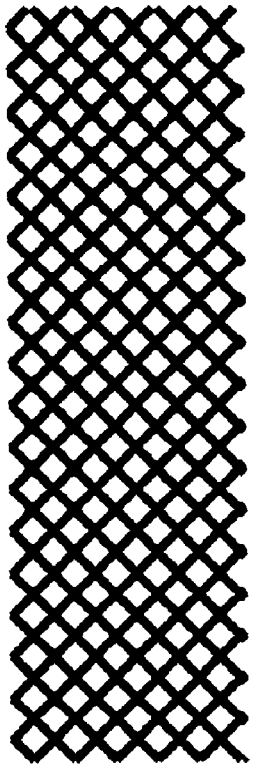
FIG. 7 is an enlarged view of a portion B in the diaphragm of FIG. 4 as viewed through the diaphragm.

The conduction patterns 203' are different from the conduction patterns 203 formed on one surface of the diaphragm 200 in the zigzagged directions. As shown in FIG. 7, the zigzagged portions on the respective surfaces together form a grid pattern as viewed through the diaphragm 200.

In the present example embodiment, the zigzag patterns are of a turn-up pattern at 45 degrees so that the zigzag patterns can be formed efficiently in high concentration.

Figure 1A:
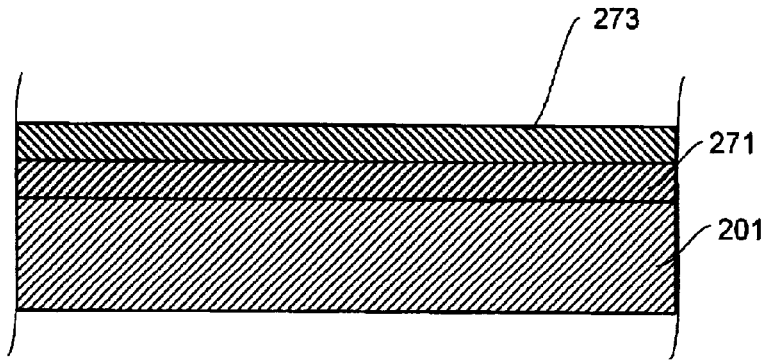
FIGS. 1A and 1B are views explaining manufacturing steps of conduction patterns on a diaphragm of one example embodiment.
Figure 1B:
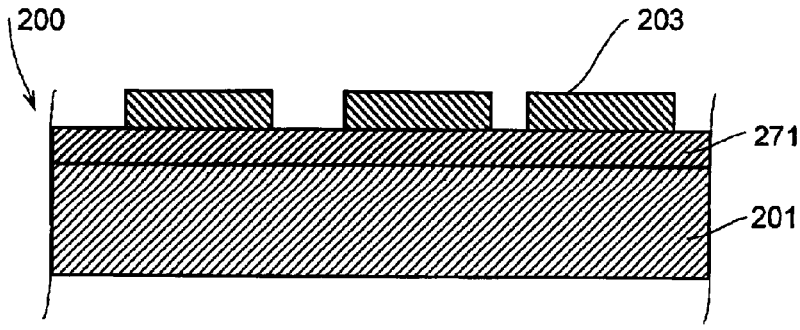

Next, the following description will describe, with reference to FIGS. 1A and 1B, a manufacturing method of the diaphragm 200 of the present example embodiment.

(1) A thin film layer 273 of conductive metal (for example, copper) is formed on a base film 201 through a bonding layer 271 (FIG. 1A).

(2) Conduction patterns 203 are formed by means of etching, while the bonding layer 271 is left intact (FIG. 1B).

Operations according to the above arrangement are as follows. That is, as a current flows through the conduction patterns 203 and 203', the conduction patterns 203 and 203' exert a driving force at the driving force generating portions 203*a* and 203*a'* that intersect at right angles with the magnetic fluxes. In case that the current is an alternating current, the diaphragm 200 vibrates and the electroacoustic transducer functions as a loudspeaker.

Further, in case that the diaphragm 200 vibrates by aerial vibrations, a current is generated at the conduction patterns 203 and 203' and the electroacoustic transducer functions as a microphone.

According to the above arrangement, the following advantages can be achieved.

(1) No problematic abrupt attenuation occurs when the diaphragm 200 vibrates, because the bonding layer 271 left in the diaphragm 200 functions as a vibration damping layer.

(2) The costs can be saved, because it is not necessary to provide a separate vibration damping layer by using the bonding layer 271 as the vibration damping layer.

(3) Distortion is lessened by forming the driving force generating portions 203*a* and 203*a'* of the conduction patterns 203 and 203' on the diaphragm 200 in a zigzag manner with respect to the magnetic gap direction G, because by so doing, the flexural rigidity in the magnetic gap direction G is reduced and so is a difference in flexural rigidity between the directions.

(4) Distortion is lessened even when the coiled conduction patterns 203 and 203' are provided respectively on the both surfaces of the diaphragm 200 to oppose each other, because the zigzagged portions of the driving force generating portions 203*a* and 203*a'* on the respective surface together form a grid pattern shown in FIG. 7 as viewed through the diaphragm 200. Hence, the flexural rigidity in the magnetic gap direction G is reduced and so is a difference in flexural rigidity between the directions of the diaphragm 200.

(5) Distortion is lessened by forming the portions that intersect at right angles with the magnetic gap direction G of the conduction patterns 203 and 203', that is the driving force non-generating portions 203*b* and 203*b'*, in a zigzag manner as well, because by so doing, the flexural rigidity in a direction intersecting at right angles with the magnetic gap direction G is reduced and so is a difference in flexural rigidity between the directions of the diaphragm 200.

(6) The workability of assembly of the diaphragm 200 is improved, because the diaphragm 200 is enabled to hold its shape by itself by providing the reinforcing portion 205 at the periphery of the diaphragm 200.

(7) Productivity is enhanced by forming the reinforcing portion 205 with the conduction patterns 203 and 203'.

(8) Productivity is enhanced by providing the reinforcing portion 205 with the locating holes 211 for use with the diaphragm 200.

(9) Productivity is enhanced by providing the reinforcing portion 205 with the clamping holes 213 for use with the diaphragm 200.

Figure 8:
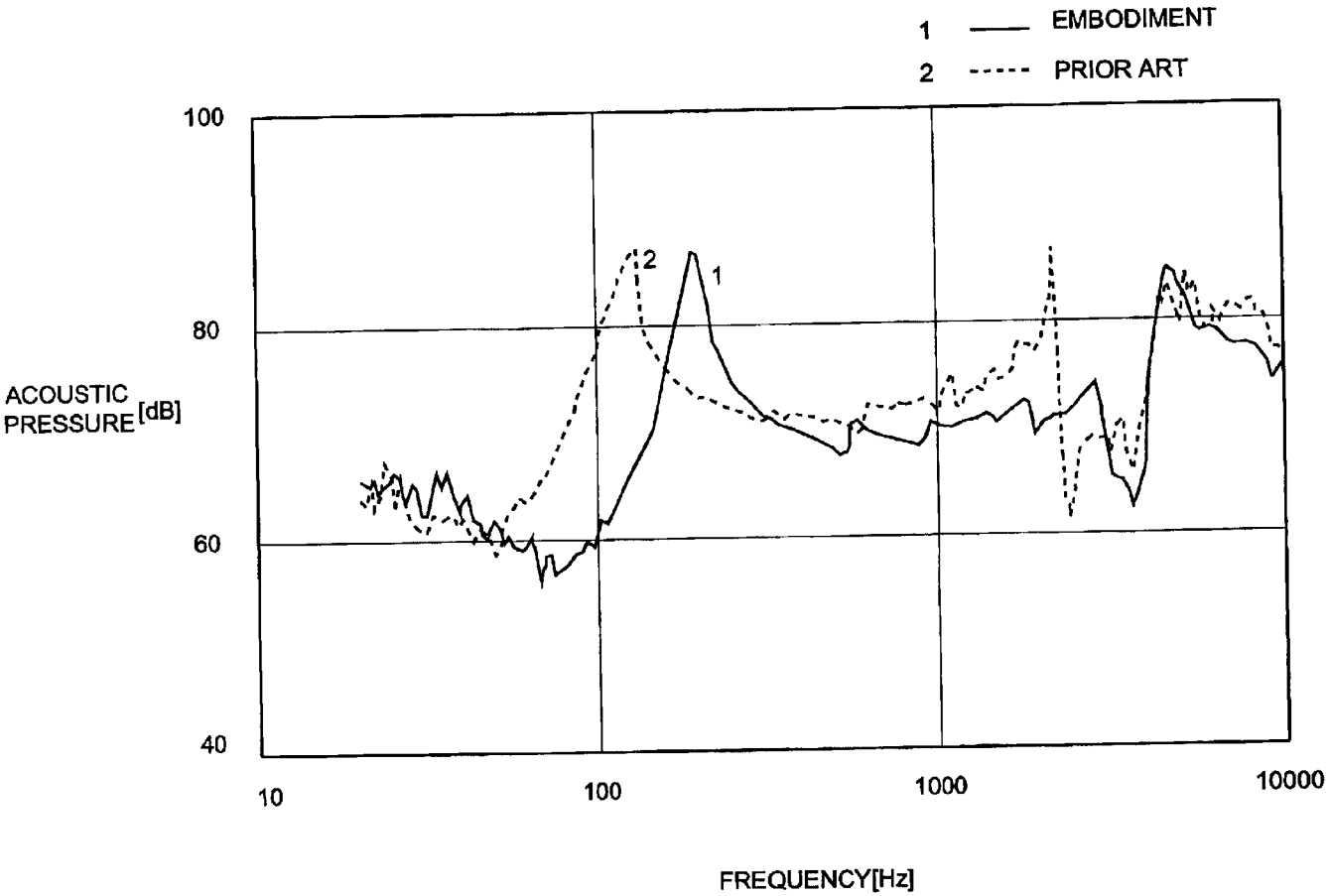
FIG. 8 is a view showing frequency characteristics of the plane driving type electroacoustic transducer of one example embodiment and those of a plane driving type electroacoustic transducer of the prior art when each is used as a loudspeaker.

FIG. 8 is a view showing frequency characteristics when the plane driving type electroacoustic transducer of the present example embodiment and a plane driving type electroacoustic transducer of the prior art are used as loudspeakers.

In the drawing, a solid line 1 denotes the present example embodiment, and a broken line 2 denotes the prior art. The drawing reveals that abrupt attenuation occurring in a range from 1000 Hz to 5000 Hz is observed in the prior art, but such abrupt attenuation is suppressed in the present example embodiment.

It should be appreciated that the present invention is not limited to the above example embodiment. The conduction patterns used in the above example embodiment were coiled, but conduction patterns of the shape as shown in FIG. 9 can be also used.

Figure 9:
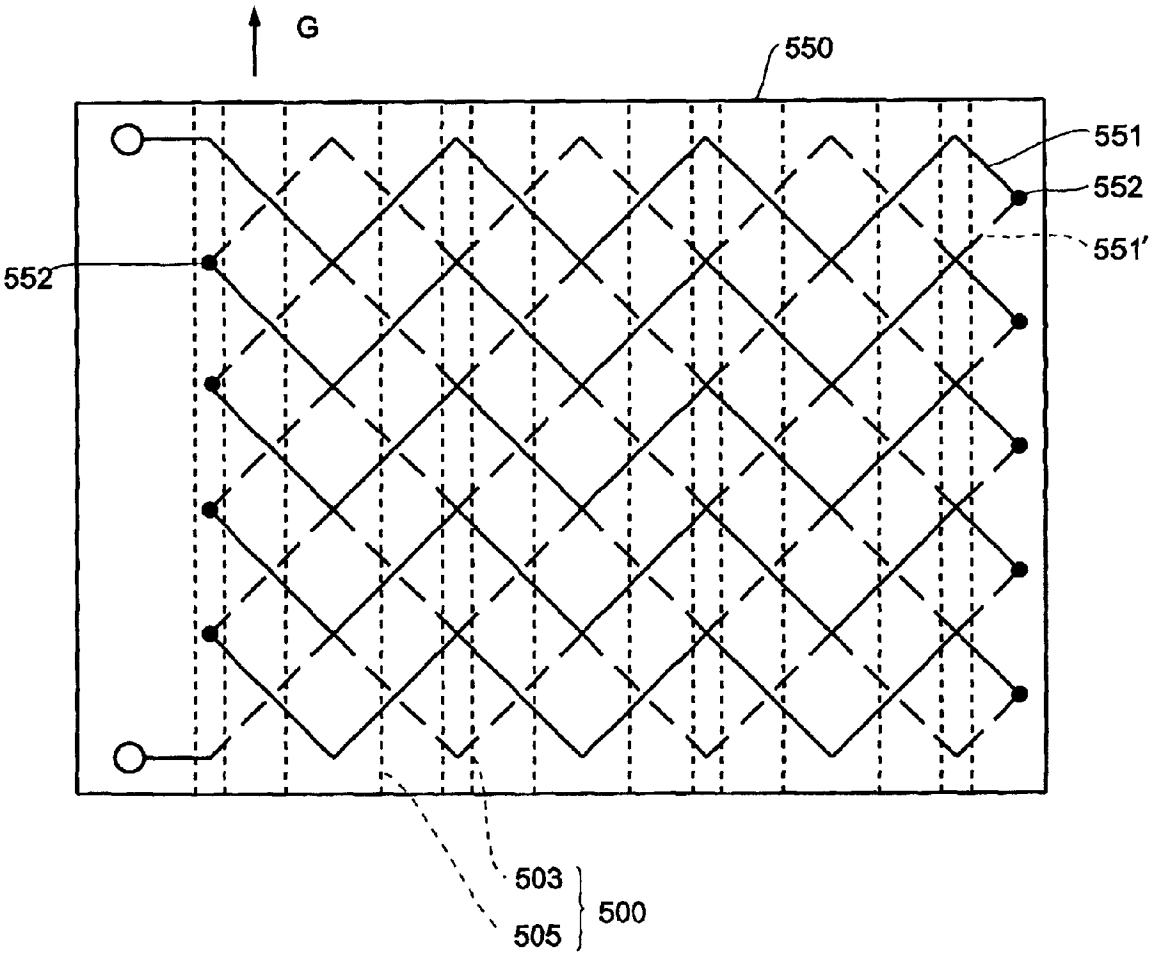
FIG. 9 is a view explaining another example embodiment.
Figure 10:
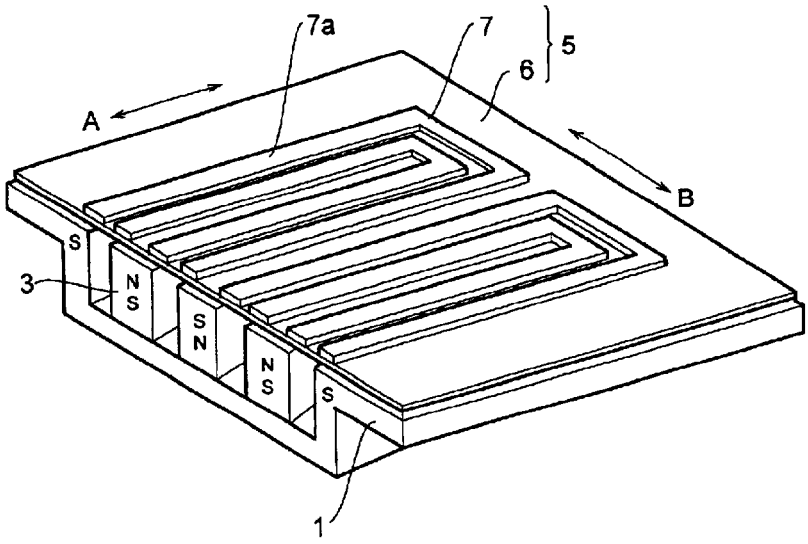
Fig. 10 PRIOR ART
FIG. 10 is a view depicting an arrangement of a plane driving type electroacoustic transducer of the prior art.

In FIG. 9, magnetic circuits 500 composed of yokes 503 and rodlike magnets 505 magnetized in the same direction are arranged in the same manner as the above example embodiment, and a direction G indicated by an arrow is the magnetic gap direction.

Conduction patterns 551 (solid line) are formed on one surface of a diaphragm 550 in a zigzag manner with respect to a direction intersecting at right angles with the magnetic gap direction G, and conduction patterns 551' (broken line) are also formed on the other surface in a zigzag manner with respect to the direction intersecting at right angles with the magnetic gap direction G.

Further, the conduction patterns 551 and the other conduction patterns 551' are set so that their zigzagged portions together form a gird pattern as viewed through the diaphragm 550.

In addition, the conduction patterns 551 and the other conduction patterns 551' are electrically connected to each other through two-surfaces conducting portions 552.

According to the above arrangement, the following advantages can be achieved.

(1) Distortion is lessened by forming the conduction patterns 551 and 551' in a zigzag manner with respect to the direction intersecting at right angles with the magnetic gap direction G, because by so doing, there is little difference in flexural rigidity between the directions of the diaphragm 550.

(2) Distortion is lessened even when the conduction patterns 551 and 551' are provided respectively on the both surfaces of the diaphragm 550, because the zigzagged portions of the conduction patterns 551 and 551' on the respective surfaces together form a grid pattern as viewed through the diaphragm 550, and as a consequence, a difference in flexural rigidity between the directions of the diaphragm 550 is reduced.

As has been discussed, according to the first aspect of the invention, by providing the vibration damping layer on the diaphragm, problematic abrupt attenuation does not occur when the diaphragm vibrates.

According to the second aspect of the invention, by using the bonding layer as the vibration damping layer, a separate vibration damping layer does not have to be provided, thereby making it possible to save the costs.

According to the third aspect of the invention, by forming the driving force generating portion of the conduction pattern in a zigzag manner with respect to a direction (magnetic gap direction) intersecting at right angles with a direction of a magnetic flux of the magnetic circuit along a planar direction of the film of diaphragm, the flexural rigidity in the magnetic gap direction is reduced, and as a consequence, a difference in flexural rigidity between the directions is lessened and so is the distortion.

According to the fourth aspect of the invention, even when the coiled conduction pattern is provided on the both surfaces of the diaphragm to oppose each other, zigzagged portions of the driving force generating portions on the respective surfaces together form a grid pattern as viewed through the film of diaphragm. Hence, the flexural rigidity in the magnetic gap direction is reduced, and as a consequence, a difference in flexural rigidity between the directions of the diaphragm is lessened, and so is the distortion.

According to the fifth aspect of the invention, by forming the conduction pattern in a zigzag manner with respect to a direction intersecting at right angles with the magnetic gap direction, there is little difference in flexural rigidity between the directions of the diaphragm, and as a consequence, the distortion is lessened.

According to the sixth aspect of the invention, by providing the conduction pattern on the both surfaces of the film of diaphragm so that zigzagged portions of the conduction patterns on the respective surfaces together form a grid pattern as viewed through the film of diaphragm, a difference in flexural rigidity between the directions of the diaphragm is lessened and so is the distortion.

According to the seventh aspect of the invention, by providing the reinforcing portion at the periphery of the diaphragm, the diaphragm is enabled to hold its shape by itself, thereby improving the workability of assembly of the diaphragm.

According to the eighth aspect of the invention, by forming the reinforcing portion with the conduction pattern, the productivity is enhanced.

According to the ninth aspect of the invention, by providing the reinforcing portion with a locating hole for use with the diaphragm, the productivity is enhanced.

According to the tenth aspect of the invention, by providing the reinforcing portion with a clamping hole for use with the diaphragm, the productivity is enhanced.

What is claimed is:

1. A plane driving type electroacoustic transducer comprising a film of diaphragm with a conduction pattern formed thereon and a magnetic circuit, wherein:

said conduction pattern is coiled and said diaphragm is essentially flat where the conduction pattern is formed; and a driving force generating portion of said conduction pattern is formed in a zigzag manner with respect to a direction intersecting at right angles with a direction of a magnetic flux of said magnetic circuit along a planar direction of said film of diaphragm.

2. The plane driving type electroacoustic transducer according to claim 1, wherein:

said coiled conduction pattern is provided on both surfaces of said film of diaphragm at a same position; and zigzagged portions of said driving force generating portions on respective surfaces together form a grid pattern as viewed through said film of diaphragm.

3. A plane driving type electroacoustic transducer comprising a film of diaphragm with a conduction pattern formed thereon and a magnetic circuit, wherein said diaphragm is essentially flat where the conduction pattern is formed and said conduction pattern is formed in a zigzag manner with respect to a direction intersecting at right angles with a magnetic gap direction.

4. The plane driving type electroacoustic transducer according to claim 3, wherein:

said conduction pattern is provided on both surfaces of said film of diaphragm; and zigzagged portions of said conduction patterns on respective surfaces together form a grid pattern as viewed through said film of diaphragm.

* * * * *